United States Patent [19]

Flood

[11] 4,266,388

[45] May 12, 1981

[54] SHINGLING TEMPLATE AND METHOD

[75] Inventor: David N. Flood, Clearwater, Fla.

[73] Assignee: The Celotex Corporation

[21] Appl. No.: 73,580

[22] Filed: Sep. 7, 1979

[51] Int. Cl.[3] ..... E04D 3/32; E04D 15/02

[52] U.S. Cl. ..... 52/748; 33/174 G; 33/188; 52/105; 52/173 R; 206/323

[58] Field of Search ..... 52/748, 173 R, 105; 33/188, 187, 174 G; 206/323, 574, 575; 182/45; 229/87 R

[56] References Cited

U.S. PATENT DOCUMENTS

| | | | |
|---|---|---|---|
| 823,874 | 6/1906 | Jones | 33/188 |
| 1,077,095 | 10/1913 | Orth | 52/559 |
| 1,433,772 | 10/1922 | Barclay | 33/188 |
| 1,499,220 | 6/1924 | Katzman | 206/574 |
| 1,668,269 | 5/1928 | Faison . | |
| 1,872,185 | 8/1932 | Reade | 52/105 X |
| 1,898,989 | 2/1933 | Harshferger | 52/748 |
| 2,250,432 | 7/1941 | Wilson | 52/748 |
| 2,762,130 | 9/1956 | Olson . | |
| 2,887,781 | 5/1959 | Mills . | |
| 2,970,860 | 2/1961 | Belk . | |
| 3,196,581 | 7/1965 | Castelli . | |
| 3,302,920 | 2/1967 | Dupage et al. | 33/174 G X |
| 3,775,856 | 12/1973 | Schmidt | 33/174 G X |
| 3,866,644 | 2/1975 | Stubbs | 144/288 C |
| 4,010,592 | 3/1977 | Nixon | 52/748 |
| 4,056,889 | 11/1977 | Barnett | 33/188 |
| 4,110,911 | 9/1978 | Sucheck | 33/188 |

*Primary Examiner*—Alfred C. Perham

*Attorney, Agent, or Firm*—James W. Grace; Charles W. Vanecek

[57] ABSTRACT

A template for positioning an array of overlapping shingles on a roof comprises a body member having a side edge contoured to fit the side edge pattern of the array of shingles to be established on the roof, whereby the shingle positioning is accomplished by setting on the roof a first shingle of the array, positioning the template on the roof so that a portion of its contoured side edge abuts the corresponding side edge portion of the first shingle of the array and thereafter guiding the placement on the roof of each of the remaining shingles of the array by abutting a side edge portion of each against the corresponding side edge portion of the template's contoured side edge.

21 Claims, 5 Drawing Figures

SHINGLING TEMPLATE AND METHOD

BACKGROUND OF THE INVENTION

1. Field of the Invention

This invention is directed to a guide for use in accomplishing the accurate and speedy, as well as economical, laying of shingles.

2. Description of the Prior Art

The process of applying roofing or siding shingles to a building is an arduous task. Roofers are required to work on steep surfaces, to assume uncomfortable positions in doing so and to bear the discomforts of the weather in the process. Moreover, even apart from these factors, the accurate installation of shingles is in itself a difficult job, which requires that the courses of shingles be regularly positioned to provide a neat and uniform exterior appearance for the building. The failure to properly position the shingles can eventually lead to an inadequate moisture and weather resistance in the roof and result in leaks or cracks therein.

The job of properly laying shingles is still further complicated in the case of strip roofing shingles of the variety requiring a rather intricate layup pattern. In applying this type of shingles, much reliance has been placed in the past on the skill and accuracy of the roofer in following rather complex layup pattern procedures, usually unique to the particular shingle design at issue. The roofer would be required to go through a difficult and time consuming sequence of relatively complex measurements to establish the proper layup pattern. There is definitely a need for a simple guide to relieve the roofing applicator of this burdensome process.

There have been numerous devices and means utilized with the object of simplifying and speeding up the application of shingles, slate, tiles, shakes and the like on surfaces. One method involves the application of chalk lines to the roof or exterior wall to provide regular horizontal and vertical reference lines for use in attaching the shingles. This process is a time-consuming one and would involve very detailed measurements for laying strip shingles having a complex pattern. In another method disclosed in U.S. Pat. No. 1,668,269, the intersecting guide lines are previously imprinted on a sheeting-cover of felt or like material and the thus formed pattern-chart is then placed on the roof deck to guide the shingle placement. The printing of this type of cover sheet is itself a troublesome process and a great deal of care must be taken to accurately position it on the roof deck, whether it consists of one large preprinted sheet or, more likely, a plurality of such sheets.

Many gages or jigs have been devised to simplify the shingling process. For example, U.S. Pat. No. 2,762,130 discloses a gage having an upper edge to position an inner layer of shingles or shakes and an abutment below the upper edge to position an outer layer of said shingles or shakes. U.S. Pat. No. 2,887,781 shows an aligning jig which consists of one plate superimposed on another plate and adjustable thereon, said superimposed plate being adapted for positioning and holding a row of shingles to be laid on a roof. Shingle alignment devices requiring a number of cooperatively working parts are further disclosed in U.S. Pat. Nos. 4,056,889 and 4,110,911. While each of these prior art jigs has helped to simplify and speed up the shingling process, there still remains a need for an inexpensive alignment guide which is easy to use and will ensure the proper positioning of the shingles on the building surface. It would be especially desirable for the shingling device to have a simple and inexpensive design so that a home or nonprofessional installer can use it without the need for special training or equipment.

OBJECTS OF THE INVENTION

It is therefore an object of the present invention to provide a new and improved template which can be utilized for properly positioning and speedily applying shingles or the like on a surface.

It is a further object of the present invention to provide an improved shingling template which is particularly well adapted for the quick and easy installation of the type of multi-tab shingle units which are designed to create a random looking appearance on a surface.

It is a still further object of the present invention to provide a template which comprises a thin, flat, main body portion having a side edge contoured to correspond to the side edge pattern of a group of overlapping shingles, whereby said template side edge serves as a guide in installing said group of shingles.

It is another object of the present invention to provide a shingling template having a relatively simple and inexpensive design which can be utilized with ease in the shingling process by even an inexperienced home installer.

It is still another object of the present invention to provide a method of installing an array of successive courses of overlapping shingles on a surface comprising placing on the surface a template which has a side edge contoured to match the recurring shingle side edge pattern to be established within the array, employing the contoured side edge of the template as a guide for positioning on the surface the first shingle of each of the successive courses in an orderly, overlapping aggregate, removing the template from the surface and completing each of the successive courses of shingles.

Other objects and advantages of the present invention will become apparent to those skilled in the art when the instant disclosure is read in conjunction with the accompanying drawings in which like numerals indicate like elements.

SUMMARY OF THE INVENTION

This invention is directed to a template (1) designed for placement on the exterior surface of a structure which is to be covered, as by shingles, and (2) provided with an edge pattern which serves as a guide for the positioning of the cover units on said surface. The template of the invention is of particular value in the application of roofing shingles which, by the nature of their design, require an irregular, simulated-random-look layup pattern, with the shingles in an offset sequence from course to course.

Among the shingles of this type are those having a multiple tab configuration, such as asphalt composition strip shingles. The appearance of randomness is developed in the shingle assembly by staggering or offsetting the individual shingle units between adjacent courses, using varied offset dimensions within a given array. In addition, each successive course of shingles is laid so as to overlap the next lower course. In this process a pattern can be established for the shingles of a given series of x successive courses. The shingles can be applied so that this pattern is repeated for the next succeeding series of x courses and so forth on up the roof or other surface being shingled.

The establishment of the pattern for each specific series of courses can be illustrated as follows for a repeating series of 4 courses: a first shingle of the lowermost first course is set down on a surface; a second shingle (first of the second course) is next positioned upward from and in an overlapping and laterally offset position with respect to said first shingle; a third shingle (first of the third course) is next positioned upward from and in an overlapping and laterally offset position with respect to said second shingle; and so forth for the fourth shingle. The positioning of each of the above four shingles is performed in accordance with the pattern to be established. In general practice this includes the use of a rule or other measuring device. The shingling of a rectangular roof deck in accordance with the present invention is commonly begun by positioning and nailing a full shingle in the lower left-hand corner of the prepared deck, even with the eave and rake. Where a repeating series of 4 courses is being laid as above and each succeeding full shingle is offset to the left of the next lower shingle it partially overlaps, a portion of each of the succeeding three shingles will extend beyond the rake of the roof. This portion can be trimmed off in the usual way.

After these first four shingles have been set in place on a surface, as e.g. at the lower left-hand corner of a roof, completion of the four courses is readily accomplished by abutting in turn the left-hand edge of each of the remaining shingles of the first course against the right-hand edge of the shingle to its immediate left and attaching each of said remaining shingles to the surface, and so forth for the other three courses. The shingling process is thereafter repeated for each sequential set of four rows or part thereof to the peak of the roof.

The template of the invention simplifies this shingling process by functioning as a guide to position the first shingles of a series of courses being applied. This series of courses is then completed in a conventional way. After this, the template is repositioned to guide the placement of the next succeeding series of courses, and so forth until the entire surface is shingled.

The template is a simple structure which may be fabricated of cardboard or any other suitable material. It comprises a flat main body portion having a side edge contoured to fit the side edge pattern of the first group of overlapping shingles to be applied. The process of utilizing the template for installing an array of successive courses of overlapping shingles on a surface comprises placing it on the surface, employing its contoured side edge as a guide for positioning on the surface the first shingles of each of the successive courses in an orderly, overlapping aggregate, removing the template from the surface, and completing each of the successive courses of shingles. This process is thereafter repeated for each sequential array or part thereof to the peak of the roof.

DETAILED DESCRIPTION OF THE INVENTION

This invention will be described as embodied in the shingling assembly and operation as illustrated in FIGS. 1 to 5. The template and method of the invention is especially useful in laying strip roofing shingles. It is to be understood, however, that the dimensions, arrangement and assembly of the shingles and the dimensions of the template shown in this typical construction could be changed in various ways, and the concept of the invention would still be effective in providing a unique placement guide for application of shingles to a building structure. The template can also be utilized to install shakes, tiles, slate and the like on a surface.

Figure 1:
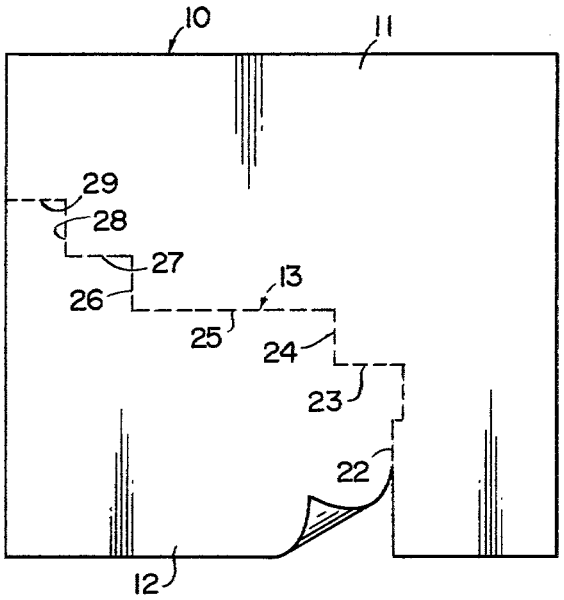
FIG. 1 is a plan view of a sheet having the contoured side edge of the template of the invention marked by dotted lines and showing the lower left-hand section of the sheet being separated from the template.
Figure 2:
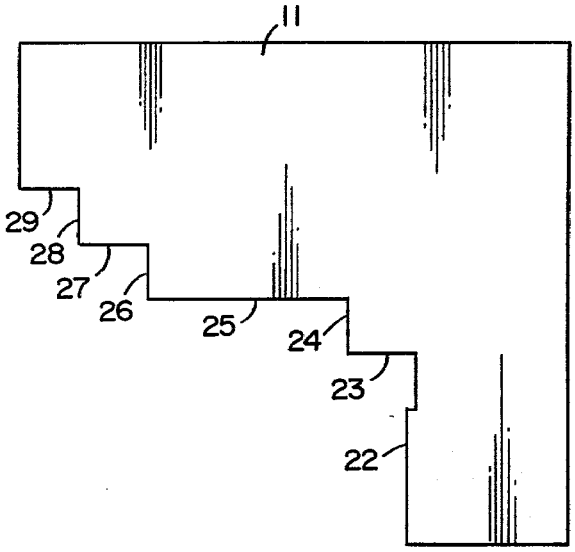
FIG. 2 is a plan view of the template of the invention after complete removal of the corner section shown in FIG. 1.

Referring now to the drawings, FIG. 1 shows a rectangularly shaped sheet 10 of any suitable material, a portion 11 of which comprises the template of the present invention. Sheet 10 can be made of various materials, as e.g. paper, paperboard, plastic, metal, etc. A cardboard construction has been found very advantageous. While only section 11 of the sheet is utilized as the template of the invention, the whole sheet 10 can function as a shingle packaging material. In practice, a bundle of shingles is packaged in a flat cardboard sheet 10 and this package is transported to the shingling site. Product identification and general application instructions are printed on the outer visible surface of the package. On the inner surface of wrapper 10 (shown in FIG. 1) are printed instructions for use of the template of the invention in applying the shingles. After the package of shingles is opened at the job site, section 12 of the wrapper is cut away from template 11 along the boundary marked by dotted lines 13 and discarded. Alternatively, template or guide 11 can be included as an insert in each bundle or designated number of bundles of shingles.

Figure 3:
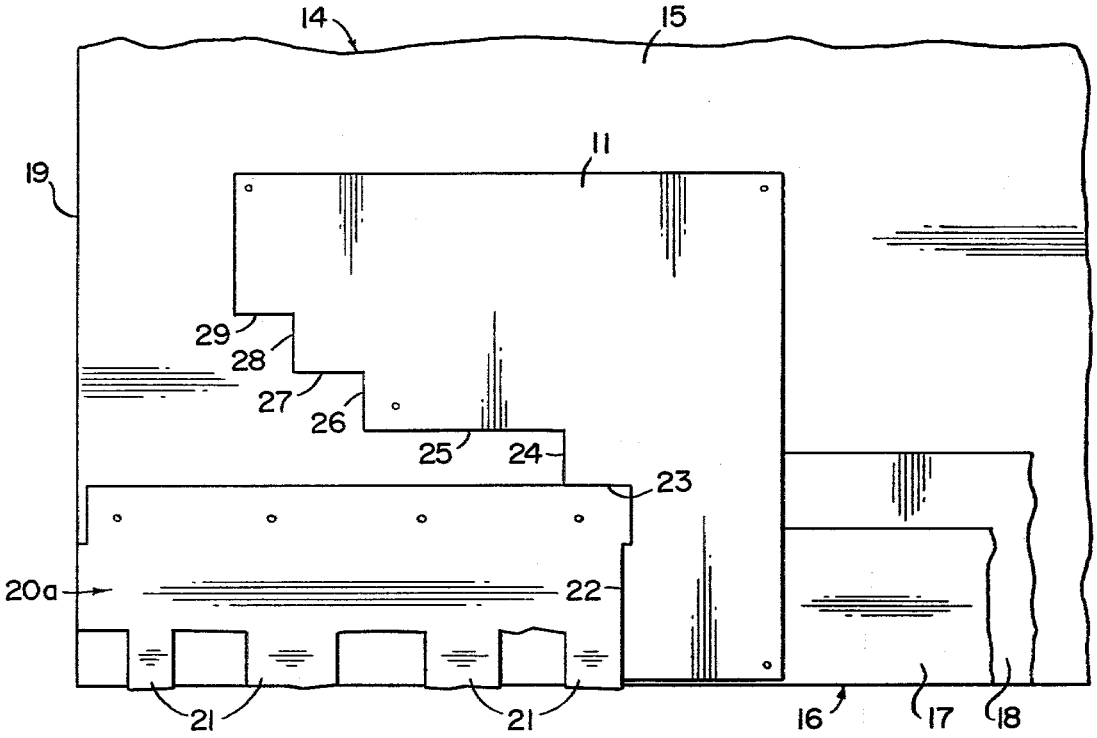
FIG. 3 is a fragmentary plan view of one corner of a roof showing the placement thereon of one shingle and of the template of the invention to abut the side edge of this shingle.

FIG. 3 shows the lower left-hand corner 14 of an ordinary roof-deck having a felt underlayment 15. Along the eave 16 of the deck from one side thereof to the other run two starter strips 17 and 18. The application of shingles in accordance with the present invention is advantageously begun at the left-hand rake 19 of the roof. A full shingle **20*a* is positioned and nailed in the lower left corner of the prepared deck, even with the eave 16 and rake 19 as shown in FIG. 3**.

Figure 4:
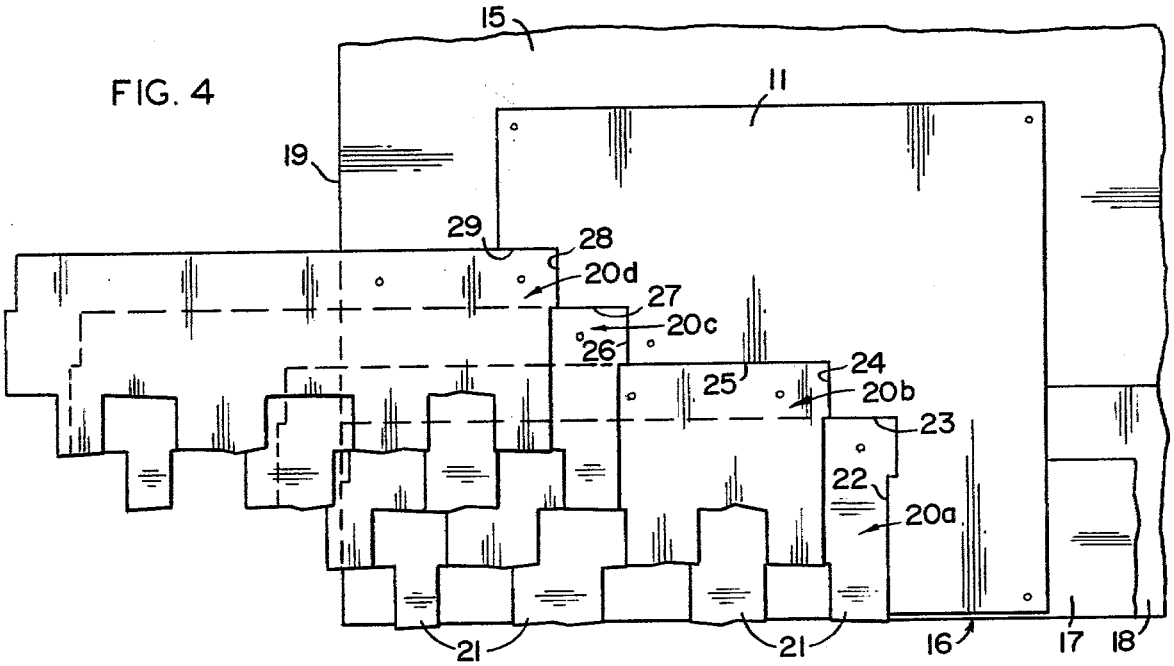
FIG. 4 is a fragmentary plan view of the roof corner of FIG. 3 showing the placement thereon of an assembly of four overlapping shingles positioned so that the side edge pattern of the assembly abuts the contoured side edge pattern of the template (the shingle portions overlapping the left-hand roof edge are cut off in practice)
Figure 5:
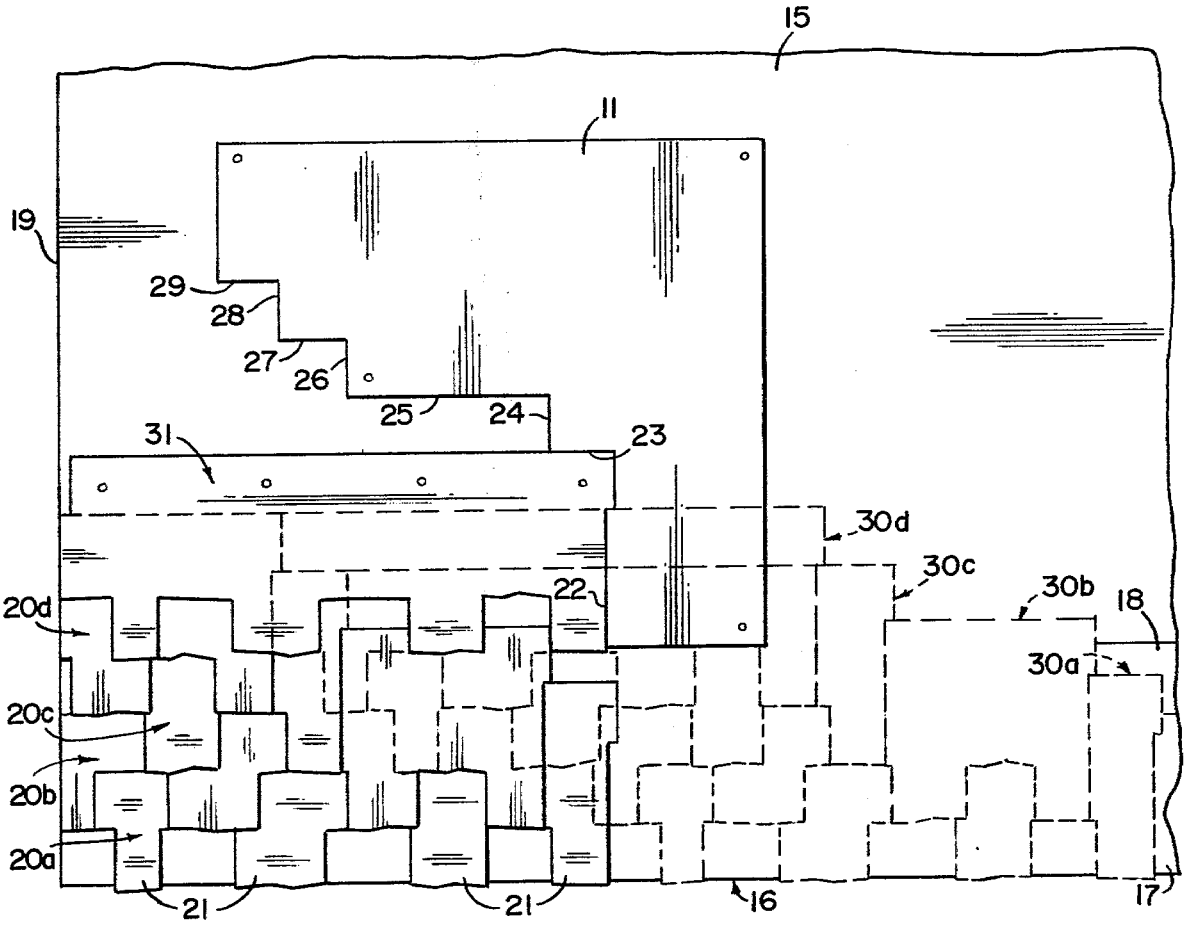
FIG. 5 is a plan view of the roof corner of FIG. 4 showing the placement of (1) the next four overlapping shingles to the right of the shingle assembly of FIG. 4 and (2) the start of a second assembly of four shingles by positioning a first shingle and repositioning the template of the invention to abut the side edge of this shingle.

While the shingling process described in FIGS. 3 to 5 starts at the left-hand rake of the roof, the shingles can be laid by starting from an intermediate point along the roof. In this case a vertical chalk line is drawn up the roof deck from the right side of the positioned starting shingle. After the positioning of this starting shingle, the template 11 is utilized in the same manner as explained hereinafter in connection with FIGS. 3 to 5. The chalk line serves as a guide for positioning the first shingle of each succeeding set of shingle courses on up the roof, just as the rake serves this function when the shingling is begun at the roof edge. No matter where the shingling process of the invention is begun, the shingles are trimmed at the rake or hip of the roof in the usual way.

As can be seen in FIG. 3, shingle 20*a* is a strip roofing shingle having four deep tabs 21. Typical strip shingles for application in accordance with the invention are the asphalt varied tab strip shingles manufactured by The Celotex Corporation under the tradename Dimensional Shake Shingles. These shingles are the subject of U.S. Pat. No. Des. 247,786, Apr. 25, 1978 and are typically 14"×40". The template of the invention is particularly suited for use in laying strip roofing shingles of this type because it eliminates the relatively complex sequence of measurements that would otherwise be required in order to establish the proper layup pattern. Those skilled in the art will recognize that shingles having any number of tabs may be used without departing from the scope of the present invention. It is to be understood that the template and method of the invention are not confined to any one shingle type but are broadly applicable to shingles of various sizes and designs.

After full shingle 20*a* is secured in place, template 11 is fitted against this shingle by bringing the left-hand, lower edge portion of the template, which has the contour of the right end portion of shingle 20*a*, flush up against said shingle right end portion (see FIG. 3). This positioning is readily accomplished because the left-hand, lower edge of template 11 is dimensioned to fit squarely against the right end portion of shingle 20*a*, having a generally vertically extending edge 22 which corresponds to the shingle's right-hand side edge and a horizontally extending edge 23 which corresponds to a portion of the shingle's right-hand top edge. Once the template is properly positioned, it is then temporarily secured to the deck by any suitable means, as by tacking, to prevent its shifting during the following positioning steps. The attachment of the template to the deck need only provide a temporary bond so that the template can be reused in starting succeeding groups of shingle courses.

The next step is to place the first shingle 20*b* of the second course in an overlapping and offset relationship with shingle 20*a* (see FIG. 4). Shingle 20*b* is positioned by fitting its right end portion against the contoured portion provided for it on template 11. For this purpose, the contoured side edge of the template is provided with a vertically extending edge portion 24 essentially at a right angle to a horizontally extending edge portion 25, edge portion 24 corresponding to shingle 20*b*'s upper right-hand side edge and edge portion 25 corresponding to a portion of the shingle's right-hand top edge. After it is positioned, shingle 20*b* is nailed to the deck and its excess portion at the rake is trimmed off in a conventional manner.

The first shingle 20*c* of the third course and the first shingle 20*b* of the fourth course are applied in an analogous manner to that described above for shingle 20*b* of the second course, with right-angled edge portions 26 and 27 of the template edge pattern serving to position shingle 20*c* and right-angled edge portions 28 and 29 serving to position shingle 20*d*. The view of the first four shingles appearing in FIG. 4 is simply for illustration purposes and shows the shingles (partially phantom views) as they would appear without any trimming at rake 19.

After shingle 20*d* has been nailed and trimmed, template 11 is removed from the deck and each of the first four courses is completed. These courses may be completed in a continuous operation. Alternatively, their installation may be interrupted at some convenient point and resumed later. Completion of these courses is accomplished by abutting the left-hand edge of the next shingle to be applied in each course against the right-hand edge of the applied shingle to its immediate left in the course and attaching said next shingle to the roof, and so forth, in the accustomed manner, to the other side of the roof. The next four shingles to the right of shingles 20*a–d* are shown as phantom shingles 30*a–d* in FIG. 5. Horizontal chalk lines drawn parallel to eave 16 can be utilized to assist in the alignment of each successive course of shingles across the roof.

The above-described shingling process is repeated for each succeeding series of four courses or part thereof to the peak of the roof. In each case a full shingle 31 (see FIG. 5) is first nailed at the left-hand rake of the roof in the next upper or first course of the succeeding series of four courses to be applied. Template 11 is then repositioned as shown in FIG. 5 to fit against the right-hand end portion of this shingle and is fastened to the deck. The next three shingles are positioned and secured to the deck in the manner described above for shingles 20*b–d* and the four courses are thereafter completed in the usual way.

The template of the present invention provides a simple-to-use guide to position the first shingle in each of a series of successive courses on the roof. Although the shingling process outlined immediately above began with the positioning and nailing of a full shingle, the process can as well be started by first positioning and securing the template with reference to the left-hand side edge or some other point on the roof and thereafter utilizing its contoured side edge to guide the placement of the first shingle of each of the successive courses. Also, the contoured side edge pattern of template 11 can be extended to include an alignment edge shaped to correspond to an end portion of the first shingle of the next succeeding series of courses. This side edge pattern permits the application of the latter first shingle immediately after the first shingles of the next lower series of courses have been applied.

It is apparent that the shingle template of the present invention is not only simple and inexpensive in construction, but also simple to use and operate. The shingle template of the present invention thus provides a simple means to insure the proper application of asphalt strip roofing shingles designed to simulate wood shakes. In the form of a simple-to-use cardboard guide, it can save the roofer valuable time and expense. It relieves the roofer of the time consuming skill of making numerous sequences of measurements to establish the correct shingle layup pattern and thus eliminates the measuring and spacing errors often related to irregularly offset or "random" type shingle applications. The template of the invention is therefore particularly useful in applying these irregularly offset shingle arrays where the degree of offsetting is not the same for the shingles of each successive course. The roofer uses the cardboard spacer as a guide to position the first shingle in each of a series of courses on the roof. After installing this series of courses, he repositions the spacer and repeats the process. The end result is reduced labor costs for the roofer and an attractive roof resembling randomly applied wood shake shingles.

Whereas the present invention has been described with respect to specific embodiments thereof, it should be understood that the invention is not limited thereto, as many modifications thereof may be made. It is, therefore, contemplated to cover by the present application any and all such modifications as fall within the true spirit and scope of the appended claims.

I claim:

1. A template for positioning an array of overlapping cover units on a surface comprising a body member having a side edge contoured to fit the side edge pattern of the array of cover units to be established on the surface, whereby the cover unit positioning can be accomplished by setting on the surface a first cover unit of the array, positioning the template on the surface so that a portion of its contoured side edge abuts the corresponding side edge portion of the first cover unit of the array, and thereafter guiding the placement on the surface of each of the remaining cover units of the array by abutting a side edge portion of each against the corresponding side edge portion of the template's contoured side edge.

2. The template of claim 1 wherein the side edge of the template has the side end contour of the array of overlapping cover units to be established on the surface, wherein each of the cover units is to be laid in a different course of a series of successive courses on the surface, the cover unit in each succeeding course, which is to be located upward from the lowermost course of the series, to be positioned in a predetermined, laterally offset relation to the cover unit in the previously laid, lower course.

3. The template of claim 2 wherein the side edge of the template is contoured to fit the side end contour of an array of irregularly offset cover units.

4. The template of claim 3 wherein the side edge of the template is contoured to fit the side end contour of a series of four successive courses.

5. The template of claim 1 comprising a flat, relatively thin, integral body of uniform thickness having a side edge of the same contour as the side end portion of the array of overlapping cover units, the body being formed from a rectangular sheet by cutting into one side edge of the sheet the contour of the side end portion of the array of overlapping units.

6. The template of claim 5 wherein the template is constructed of cardboard.

7. A template for positioning an array of overlapping shingles on a surface comprising a flat, relatively thin, integral cardboard body of uniform thickness having a side edge of the same contour as the side end portion of the array of overlapping shingles, wherein each of the shingles is to be laid in a different course of a series of successive courses on the surface, the shingles in each succeeding course, which is to be located upward from the lowermost course of the series, to be positioned in a predetermined, laterally offset relation to the shingle in the previously laid, lower course.

8. The template of claim 7 wherein the side edge of the template is contoured to fit the side end contour of an array of irregularly offset shingles.

9. The template of claim 8 wherein the side edge of the template is contoured to fit the side end contour of a series of four successive courses.

10. A sheet of material for packaging a plurality of cover units which are to be applied to a surface, said sheet (1) having imprinted interiorly on its surface the side edge pattern to be established for an overlapping array of the cover units on the surface to be covered, and (2) adapted to be cut along said side edge pattern to thereby (a) expose the patterned side edge for use as a placement guide in applying the overlapping array of cover units and (b) remove that portion of the sheet material bordering the imprinted side edge pattern that would otherwise interfere with said use of the sheet's exposed side edge as a placement guide.

11. The sheet of claim 10 wherein said sheet is composed of cardboard.

12. A method of installing an array of overlapping cover units in successive courses on a surface comprising the steps of placing on the surface a template which has a side edge contoured to match the recurring cover unit side edge pattern to be established within the array, employing the contoured side edge of the template as a guide for positioning on the surface the first cover unit of each of the successive courses in an orderly, overlapping aggregate, and fastening each of the first cover units to the surface.

13. The method of claim 12 wherein the successive courses of cover units are completed by removing the template from the surface and adding the remaining cover units of the courses.

14. The method of claim 12 which includes the additional steps of removing the template from the surface and repositioning it on the surface to begin one or more additional series of successive courses of overlapping cover units.

15. The method of claim 14 wherein each of the courses of cover units is completed in a conventional manner.

16. The method of claim 12 wherein the template has its left-hand side edge contoured to match the recurring cover unit side edge pattern, the method comprising the steps of positioning and securing a first cover unit of the lowermost first course on the surface, positioning and temporarily securing the template against said first cover unit by butting the left-hand, lower edge portion of the template against the first cover unit's right end portion, positioning each remaining first cover unit of the successive courses of cover units against the contoured side edge of the template by butting the right end portion of each of said remaining first cover units against the corresponding contoured side edge portion of the template, and securing each of said remaining first cover units to the surface.

17. The method of claim 16 wherein the successive courses of cover units are completed by removing the template from the surface and adding the remaining cover units of the courses.

18. The method of claim 16 which includes the additional steps of removing the template from the surface and repositioning it on the surface to begin one or more additional series of successive courses of overlapping cover units.

19. The method of claim 18 wherein each of the courses of cover units is completed in a conventional manner.

20. The method of claim 19 wherein the cover units are shingles and the surface is a roof.

21. The method of claim 20 wherein the installation is begun at the rake of the roof and the excess of any shingle extending beyond said rake is trimmed off.

* * * * *